US008991797B2

(12) United States Patent
Vidaurre Heiremans et al.

(10) Patent No.: US 8,991,797 B2
(45) Date of Patent: Mar. 31, 2015

(54) SELF SUPPORTING ISOBARIC STRUCTURE FOR ELECTROLYTE AERATION IN CELLS FOR ELECTROREFINING OR ELECTROWINNING NON FERRIOUS METALS

(75) Inventors: Victor Vidaurre Heiremans, Santiago (CL); Edgardo Beltran Navarro, Santiago (CL)

(73) Assignee: Ancor Tecmin, S. A., Santiago (CL)

( * ) Notice: Subject to any disclaimer, the term of this patent is extended or adjusted under 35 U.S.C. 154(b) by 725 days.

(21) Appl. No.: 13/264,384

(22) PCT Filed: Apr. 12, 2010

(86) PCT No.: PCT/EP2010/054774
§ 371 (c)(1), (2), (4) Date: Oct. 13, 2011

(87) PCT Pub. No.: WO2010/119014
PCT Pub. Date: Oct. 21, 2010

(65) Prior Publication Data

US 2012/0024698 A1 Feb. 2, 2012

(30) Foreign Application Priority Data

Apr. 14, 2009 (CL) ..... CL-000893

(51) Int. Cl.

| | |
|---|---|
| ***B01F 3/04*** | (2006.01) |
| ***C25C 7/00*** | (2006.01) |
| ***B01F 13/02*** | (2006.01) |
| ***C25C 7/06*** | (2006.01) |

(52) U.S. Cl.
CPC ..... *C25C 7/00* (2013.01); *B01F 13/0255* (2013.01); *C25C 7/06* (2013.01)
USPC ..... 261/122.1; 204/279

(58) Field of Classification Search
CPC ..... B01F 3/0412; B01F 3/04241; B01F 13/0255; C25C 7/00; C25C 7/06
USPC ..... 261/122.1; 204/279
See application file for complete search history.

(56) References Cited

U.S. PATENT DOCUMENTS

| | | | |
|---|---|---|---|
| 1,260,830 | A | 3/1918 | Studt |
| 3,928,152 | A | 12/1975 | Harvey et al. |

(Continued)

FOREIGN PATENT DOCUMENTS

| | | | |
|---|---|---|---|
| DE | 3834317 | C1 | 1/1990 |
| WO | WO2005019502 | A1 | 3/2005 |

*Primary Examiner* — Charles Bushey
(74) *Attorney, Agent, or Firm* — Karim Lagobi

(57) ABSTRACT

The invention provides a self supporting isobaric structure for electrolyte aeration in an electrodeposition cell for electrolytic refining or winning of non-ferrous metals, and a method of fabrication thereof. The structure is constructed using thermoplastic material pipes the external surface of which is wrapped in a thermosetting polymer composite material and one or more successive wrapped layers of fiber glass mats, thus forming a structural monoblock. The pipes are arranged in a reticular layout having a generally rectangular frame that follows the contour of the cell, transverse structural elements that connect the longer sides of the frame and tubular elements connecting the shorter sides of the rectangular frame. The tubular element provide a means for gas diffusion and aeration in the cell. Furthermore, the invention provides pipe couplings that allow shorter elements to be connected together in order to achieve the reticular configuration.

9 Claims, 9 Drawing Sheets

(56) References Cited

U.S. PATENT DOCUMENTS

| | | | | | |
|---|---|---|---|---|---|
| 3,959,112 | A | | 5/1976 | Arend, Jr. | |
| 4,263,120 | A | | 4/1981 | Berndt et al. | |
| 4,290,590 | A | * | 9/1981 | Montgrain | 266/225 |
| 5,560,875 | A | * | 10/1996 | Meshengisser et al. | 261/122.1 |
| 5,711,865 | A | * | 1/1998 | Caesar | 205/628 |
| 6,951,600 | B2 | * | 10/2005 | Santoyo | 204/281 |
| 7,744,069 | B2 | * | 6/2010 | Hoefken | 261/122.1 |
| 7,806,389 | B2 | * | 10/2010 | Abello et al. | 261/122.1 |
| 8,020,839 | B2 | * | 9/2011 | Smiltneek et al. | 261/122.1 |
| 2002/0011419 | A1 | | 1/2002 | Kozo Arao et al. | |
| 2005/0087894 | A1 | * | 4/2005 | Campion et al. | 261/120 |
| 2008/0102514 | A1 | | 5/2008 | Olivares et al. | |
| 2011/0229786 | A1 | * | 9/2011 | Di Iorio et al. | 429/452 |

* cited by examiner

SELF SUPPORTING ISOBARIC STRUCTURE FOR ELECTROLYTE AERATION IN CELLS FOR ELECTROREFINING OR ELECTROWINNING NON FERRIOUS METALS

TECHNICAL FIELD OF THE INVENTION

The present invention refers to a self supporting isobaric structure for electrolyte aeration in cells for electrorefining or electrowinning non ferrous metals. More particularly, the present invention is focused on the formation and specification of the appropriate materials for said structure to support high structural and mechanical stress, requirements normal in industrial operation, such as generated by the positioning, movements and operation of the isobaric structure in the cell, and include withstanding extreme impact episodes from operational events such as falls of cathodes or cathodic metal plates, and/or of worn anodes at the time of harvest.

BACKGROUND OF THE INVENTION

The concept of enhancement or improvement of the convection of the electrolyte in electrolytic cells by means of discharges of gas bubbles from an horizontal plane located near the bottom of the cell, in such a way that said discharges improve the productivity and quality electrodeposition of the processes of electrowinning of electrorefining of non ferrous metals, has been known for several decades. In the prior art, there are several designs of devices which claim attaining that objective. One of them, is an isobaric ring installed near the bottom of the cell following its interior perimeter, typically, a rectangular perimeter. These rings or loops are formed by interconnected profiles or tubes of square, rectangular or circular cross section, to form rectangular structural frames that carry in their interior the gas necessary to generate bubbles emerging from the inferior portion of the cell, under the electrodes, and rising upwards to the surface of the electrolyte. For that purpose, such rings are crossed from side to side by diffuser ducts or perforated hoses, whereby the bubbles actually emerge from perforations in the diffusers or hoses, having an initial diameter determined by the diameter of the perforations and by the height of the electrolyte hydraulic column; the bubble diameters increase as the bubbles rise, due to the diminishing hydraulic pressure towards the surface of the electrolyte. Several patent documents disclose a solution to achieve such electrolyte agitation in an electrodeposition cell.

Document U.S. Pat. No. 1,260,830, published Mar. 26, 1918, titled "Electrolytic deposition of copper from acid solutions" discloses copper electrodeposition by means of continuous agitation of the electrolyte, particularly sweeping the surface of the vertical anodes with bubbles of a mixture of sulfur dioxide gas and vapor, projected from orifices perforated in transversal lead pipes, disposed parallel to, and under, the anodes in the cell, with the orifices oriented in such a manner that the fluid emerges in an oblique angle striking the surface of the anodes, forcing a continuous electrolyte circulation, with maximum agitation and turbulence occurring by the impact of the mixture directly on the faces of the anodes.

Document U.S. Pat. No. 3,928,152, published Dec. 23, 1975, titled "Method for the electrolytic recovery of metal employing improved electrolyte convection", describes a method of high quality copper electrodeposition on permanent cathodes plates at very high current densities. To achieve high productivity, the separation between electrodes is reduced to a minimum with separators—distances that position them exactly relative to each other, and simultaneously, provide very aggressive continuous agitation of the electrolyte by gas sparging tubes placed under each cathode, disposed to sweep the faces of the cathodes with curtains of bubbles that emerge from holes perforated in the tubes.

Document U.S. Pat. No. 3,959,112 published May 25, 1976, under the title "Device for providing uniform air distribution in air-agitated electrowinning cells", discloses air bubbling device, placed transversely to the cell length and parallel on both faces of the cathodes, just below their lower edge. The devices comprise rigid perforated tubes that allow discharging air in bubbles of relatively large diameter with minimum pressure loss, whereby said tubes are enclosed externally with sleeves of larger diameter permeable material which oppose resistance and restrict the passage of the air bubbles, forcing them to emerge continuously from the sleeves as curtains of very fine bubbles that then sweep vertically both faces of the cathode and thus inhibit the formation of rugosities in the metal deposition on the cathode surface.

U.S. Pat. No. 4,263,120, published Apr. 21, 1981, under the title "Electrolytic cell for the recovery of non ferrous metals and an improved anode therefor", discloses the operation of the electrolytic process with electrolyte agitation by using of perforated gas bubbler tubes placed parallel under the anodes to create ascending electrolyte turbulence in the interfaces of the electrodes.

Document CL 527-01, published Sep. 27, 2002, today patent CL 44.803 titled "System and method to capture and extract acid mist from polymer concrete containers, were the side, frontal and back walls are modified to allow horizontal seat of a thermal cover that forms a chamber connected to extraction ducts, method of fabrication and container for such purpose", discloses a stratified polymer concrete container for electrolytic cell, together with several means to eliminate acid mist, to increase productivity and thermal performance with high current density in the processes of electrowinning and electrorefining of non ferrous metals, specially copper, which includes, among other elements, a duct for injection of fresh external air with gas diffusers installed parallel, and in a horizontal plane, in the lower portion of the cell, that direct air bubbles rising from under the electrodes.

Document CL 2120-2004, published Jul. 28, 2006, (equivalent to document WO 2005/019502) titled "Method to operate and electrolytic cell . . . " discloses gas diffusers for the transfer by gas bubbling to liquid means comprising an element consisting of a body of cylindrical connection that is prolonged in a tube conical zone ending in a closed end; between the cylindrical zone and the end zone there is a multi perforated separation wall trough which from the interior of the cylindrical body air circulates at constant pressure and velocity, generating a gas stream that distributes forming gas minijets.

Document CL 727-2006, published Jul. 7, 2006, titled "Electrolyte agitating device that consist of a reticulated structure, flat and of regular plant, formed of non electric conducting polymer composite materials resistant to corrosion, and, comprising an isobaric gas distribution ring, gas diffuser means; and electrolyte agitation system", discloses an electrolyte agitation apparatus immersed in containers for electrolytic cells used in the processes of electrowinning and electrorefining of non ferrous metal, formed by pipes of anticorrosive and non conducting materials, joined together by connecting elements, were said joined pipes cross over from one side to the other by gas diffuser means, where said joined pipes and connected elements form an isobaric ring, which is encapsulated in the interior of a continuous profile, formed monolithically of an anticorrosive dielectric polymer composite material, forming one flat, perimetral parallelepiped structure, homologous to the shape of the bottom of the container, where said perimetral structure is reticulated to impart rigidity and necessary structural resistance to be self supporting.

In general, prior art, isobaric rings are formed, by tubes of different thermoplastic materials, especially PVC, since the ring constituent materials must not be electrically conducting, resistant to heat and resistant to electrolyte corrosion present in the cell. Likewise, tubes exist that are within some type structural material to protect them from heat, from the electrolyte, as well as to provide some resistance to mechanical stresses.

SUMMARY OF THE INVENTION

As has been seen in the prior art, isobaric rings generally comprise thermoplastic tubes or profiles, specially PVC, that conform a closed rectangular perimeter loop structure that feeds an external gas or dry air to perforated hoses or diffusers running across said structure from side to side, from which the gas emerges near the bottom of the cell, as shown in FIG. (1). However, as shown in FIG. (2), when said profiles are called to resist high mechanical stress of the operation while maintaining their integrity, for example, the weight of operators that have to access the cell to check its operation or for clean up, or the accidental fall of cathodes or metal cathodic plates at the time of harvest, the high impact of any such loads can fracture them immediately. Even if they are self supporting and with sufficient rigidity, they flex or deform by their is own weight when the rings must be hauled up from the bottom of the cell and removed, as for example, to clean the anodic sludge that deposits on the bottom of the cell during normal operation FIG. 3 shows an isobaric ring formed by joined PVC tubes, totally encapsulated by a molded tube made of thermosetting polymer composite materials, designed to have simultaneously high structural, anticorrosive and non electrical conducting properties. However such encapsulation with a thermosetting structural material provide limited resistance to the high mechanical stress requirements of the application. This is because the thermoplastic PVC material of the tube does not form an integral and monolithic composite with the thermosetting encapsulation materials, thereby the composite of said pair of materials does not form a monolithic structural composite, allowing each material to act independently of the other, so that at the time of loading to withstand significant structural or mechanical stresses, as indicated above, the composite simply fails catastrophically or fractures, and thereby the ring loses its absolute integrity allowing the escape of air and compromising the pneumatic capacity and functionality of the element, and the ring must be removed from service. This is, the PVC profiles or tubes and their encapsulating structural material act independently, and do not form one monolithic structurally collaborating body, allowing it to withstand the occasional high stresses of normal use. In FIG. 2, it is possible to appreciate that the PVC tube can actually turn and move longitudinally inside the encapsulation outer seal because of the low or null interface adherence, thereby, it is impossible for both materials to form a structurally resisting pair or set to withstand repeated severe mechanical and structural stresses.

The present invention provides, in electro-obtaining methods, a self supporting isobaric structure in which the constituent elements conforming it can and do act structurally together as one rigid, monolithic structural block, specified and designed to withstand very high stresses while simultaneously maintaining its physical integrity and absolute pneumatic cathodic hermeticity or imperviousness, including impacts of falling cathodes or the detachment of cathodic metal plates at the time of harvest in the case of electrowinning process, and in the case of electrorefining processes, more over the impacts from the fall anodes by premature wear of their support lugs.

For that purpose, the present invention proposes an isobaric structure for electrolyte aeration in electrorefining or electrowinning cells for non ferrous metals, formed by hollow structural profiles, tubes or pipes, that follows the perimeter of the cell walls near the bottom of said cell, forming the isobaric structure shaped as a hollow rectangular frame that carries gas or dry air, having transversal structural elements—hollow or solid—connecting the long sides of the frame, and where the short sides of said frame, are also connected with longitudinal structural elements—hollow or solid. Preferably, the short sides of the isobaric structure are connected from side to side by hollow tubular elements, such as perforated hoses or other flexible gas diffusers means, which are supported by such transversal structural elements, in such a way, that the disposition of the structural elements as well as the polymer composite materials that form such self supporting structure, provide it sufficient rigidity to behave as a monolithic block structural frame. The structural elements that form said isobaric structure and the transverse and longitudinal reinforcements are totally enclosed externally by a thermosetting polymer composite material formed by—and reinforced—with glass fibers and/or inorganic particulate material that adheres with excellent chemical bonding to the external surface of the hollow structural profile, if thermoplastic duct and particularly PVC is used.

However, it is well known, however, that profiles of thermoplastic materials, and in particular PVC, are of low surface energy (around 34 mJ/m2) thereby having low adherence with thermosetting resin of higher surface energy (around 40/45 mJ/m2), as those used in the encapsulating polymer composite materials, and for this reason, they fail to form monolithic structural composite materials. The low adherence of the interfaces between these materials generates the problem with PVC tubes that can be rotated and displaced longitudinally in the interior of the encapsulating profile of thermosetting polymer material, and explains the impossibility of both forming monolithically structural composites capable of withstanding high mechanical and structural stresses. To achieve the object of the present invention, a third laminar polymer composite material is used, one with fiber glass—with or without additional particulate reinforcements-saturated with thermosetting resin acting is an intermediate adherence bridge. This third bridge or intermediate material adheres monolithically by its lower face to the outer surface—dully treated previously—of the thermoplastic profile or PVC tube, for activating it and providing a chemical anchorage and/or locations for mechanical anchorages to the thermosetting resin; and by it's a upper face it adheres chemically and monolithically to the encapsulating thermosetting structural polymer composite material, which is made also of compatible thermosetting resin, and accordingly, of similar surface energy. Because of the above, the isobaric structure of the invention is constituted by at least a triad of polymer composite materials, specifically for acting as one monolithic block: a base material, formed by the hollow PVC profile or other hermetic thermoplastic equivalent material; an intermediate material, acting as an adherence bridge, formed by the reinforcing glass fiber mat—with or without the additional reinforcement of inorganic particulate material—both reinforcements duly saturated with a thermosetting resin, where said glass fiber mats are placed laminarly by wrapping, in successive layers of a given thickness, over the PVC profile or thermoplastic material; and an externally, encapsulating structural profile formed by said thermosetting polymer composite containing inorganic particulate materials, reinforced with chopped glass fiber, and both reinforcements saturated with a compatible and collaborating thermosetting resin.

Additionally, in the case of existing electrodepositation operations that wish to benefit with aeration, but whose original electrolytic cells where not designed and constructed with sufficient internal clearances between the electrodes and the bottom for installing the isobaric aeration structures as described and/or where the magnitude of the anticipated mechanical and structural stress requirements which the standard isobaric structures will be subjected require very high resistance and rigidity in limited spaces, the isobaric structure formed by the monolithic material triad described above can end up with dimensions such that structural or mechanical do not fit the available spaces in the cells for installation, or if fitting, do mot have sufficient resistance. In these cases, to resolve the problem it is indispensable to use monoblock structural polymer composite materials of high resistance with less global volume so as to both form a sufficiently resistant and dimensionally apt isobaric structure. This goal can be achieved using more slender initial hollow thermoplastic profile and/or replacing part of the encapsulating polymer composite material thickness by another type of reinforcing material that is more resistant, for example, the structural triad can be reinforced with advantage, winding by the exterior additional layers continuous glass fiber roving tensioned at an adequate winding angle and saturated with thermosetting resin; or form an isobaric structure of monolithic structural composite formed by four compatible polymer materials that effectively succeed in acting together effectively as one monoblock structural composite, that exhibits much higher rigidity and higher over all structural resistance, and simultaneously, is a volumetrically slenderer than that of the monoblock triad structure.

BRIEF DESCRIPTION OF THE DRAWINGS

The attached drawings, which are included to provide a better understanding of the invention, are herewith incorporated and constitute a part of the description illustrate prior art and one of the embodiments of the invention, which together with the description, help to understand with more detail the principles of this invention.

DESCRIPTION OF PREFERRED EMBODIMENTS

The preferred embodiment according to the present invention refers to the conformation and functions of the materials for an isobaric structure or appropriate polymer composite material for the aeration of the electrolytes in cells for electrorefining or electrowinning of non ferrous metals, in order to withstand high structural mechanical electrical, thermo and chemical requirements without loosing its integrity or hermeticity, said stresses are generated in the handling, installation in the cell, and normal operating including the weights of operators, accidental fall of cathodes or cathodes metal plates, and/or the fall of anodes at the time of harvest.

Figure 1:
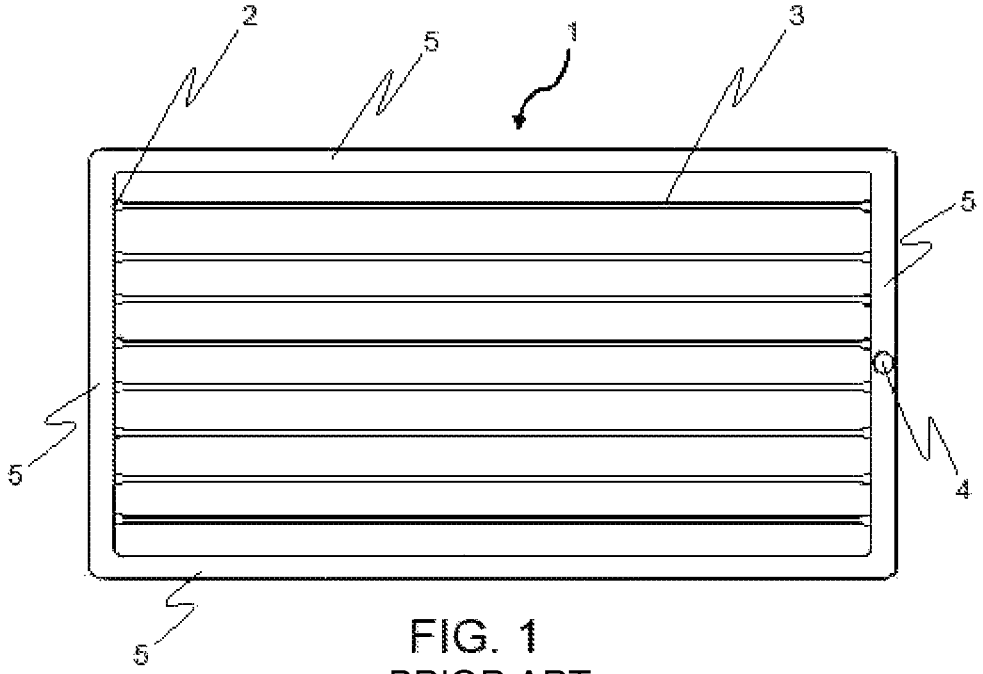
FIG. 1 PRIOR ART
FIG. 1 shows a top view of a state-of-the art isobaric ring.

FIG. 1 shows a top view of an isobaric ring (1) of the prior art, of rectangular shape, that follows generally the internal contour around the cell bottom, which is formed with thermoplastic tubes, typically PVC (5), with "T" shaped connectors (2) attached on its short ends, also PVC, which inter connect the ring (1) with perforated hoses (3). Said ring (1) is provided in its perimeter with a connection (4) for the supply of the external gas, preferably dry air, such that through the perforations of the perforated hoses (3) curtains of bubbles emanate in given appropriate sizes and patterns that enhance the natural convection of the electrolyte in the electrolytic cell and in such way that improve the results of the process of electrowinning or electrorefining non ferrous metals.

Figure 2:
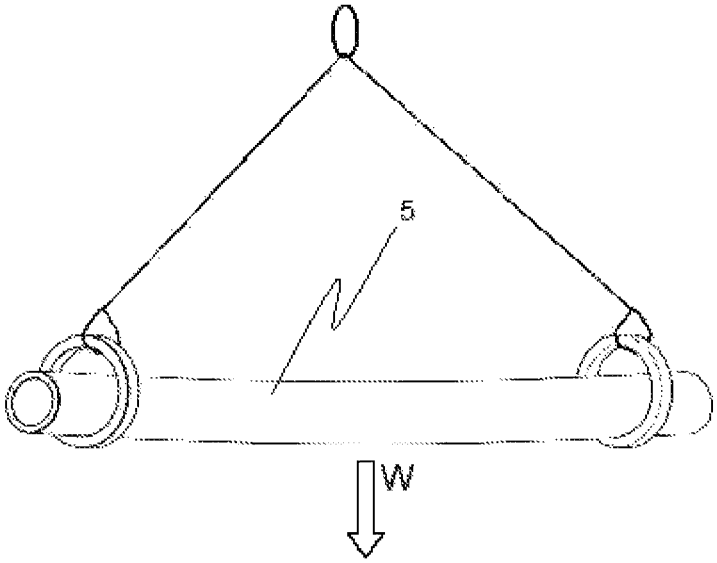
FIG. 2 PRIOR ART
FIG. 2 shows an isometric view of a piece of hollow profile or tube used to form the isobaric ring of FIG. 1, flexing by being hauled up under the weight of the complete isobaric ring, lifted from two points.
Figure 3:
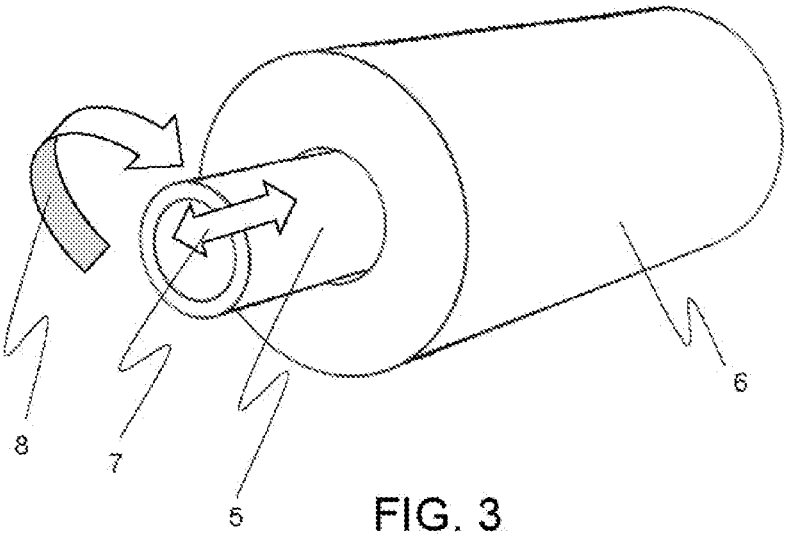
FIG. 3 PRIOR ART
FIG. 3 shows an explosion view perspective cross section of a piece of encapsulated tube of the improved formation of the state-of-the art isobaric structure.

As shown a FIG. 2, the isobaric ring of PVC tubes (5) upon being subjected to forces, for example, its structural weight (W) when hauling up to be installed in the cell, will generate deformations in the long sides of the frame plus warping/buckling throughout the ring structure, the same happens when an isobaric ring is hauled up and removed from the cell allowing access of operators to the empty cell to clean sludge that deposits on the bottom during the electrodeposition process. With such lack of structural rigidity it is not possible to resist stably, and neither for prolonged times, the forces and stresses required for it to function without comprise an eventual loss of structural integrity or collapse catastrophically, by, for a example, the effects of accidental cathode falls or cathodic metal plate during harvest, and/or of worn anodes collapsing from their lugs. Also, as shown in FIG. 3, it has been intended to resolve the problem of increasing the structural resistance of isobaric rings so they can be subjected to very high stress maintaining their structural and pneumatic integrity without loss of hermeticity. In this case, the PVC tube (5) with its external surfaces prepared for encapsulation inside a profile formed by a monolithic thermosetting polymer composite material (6). However, thermoplastic materials, like PVC, and thermosetting composite materials apt for encapsulation poor have chemical adherence with each other; thereby at the moment of being subjected to the severe stresses, the bond of adherence between them is weak and thereby do not transmit stresses from one material to the other, easily allowing PVC tube (5) to have lineal movements (7) or rotational (8) with in the encapsulating thermosetting polymer composite materials shape (6), and thus enabling them to act independently from each other instead of structurally collaborating contributing the total or at least a portion of their individual resistances. While it is true that the materials duo PVC tube/encapsulating polymer composite material provide an over all improved resistance to stresses, said PVC tube (5) and said encapsulating profile of thermosetting polymer composite material (6) are not capable of withstanding consistently large mechanical stresses overtime without loosing their physical integrity, as for example, under normal operational tasks activities such as supporting the weight of operators walking on the isobaric ring frame structure at the bottom of an empty cell for clean up or the fall of cathodes or of anodes at the time of harvesting.

The present invention refers to an isobaric structure for electrolyte aeration in cells for electrorefining or electrowinning non ferrous metals, formed by hollow structural profiles, tubes or pipes that follow the contour of the walls near the bottom of the cells, forming monolithic, hermetic structures, shaped as rectangular frame that carry gas or dry air said structure is provided with transversal structural elements as a reticula connecting opposite sides of the frame, where generally in the short sides of said frame are located tubular elements as gas diffuser means connecting from side to side, which are supported by said transversal structural elements, in such away the materials forming said structural frame act collaboratively together as one monolithic resisting block, formed by thermosetting resin reinforced with fiber glass and/or inorganic particulate material or polymer composite material that adhere robustly with good chemical bonding to the external surfaces of the core thermoplastic tubes, specially PVC.

FIGS. 4, 6, 7, and 8 show in didactic form, the formation of the materials of the present invention which allow to definitively resolve the problem of an hermetic isobaric structure apt for an industrial, cell production environment. The isobaric structure shown is formed primarily by a thermoplastic profile, such as conventional PVC tube (5), and a profile of polymer composite material or structural composite (6), both joined by means thermosetting polymer composite material that acts as a stress transfer bridge so as to make the global composite material work as a single monolithically resisting structure. The adherence bridge—where said transfer of stresses is achieved—is formed by at last one fiber mat (9), structural layer and thermosetting resin, where the fiber glass mat is wrapped a over the exterior of the PVC tube.

Figure 4:
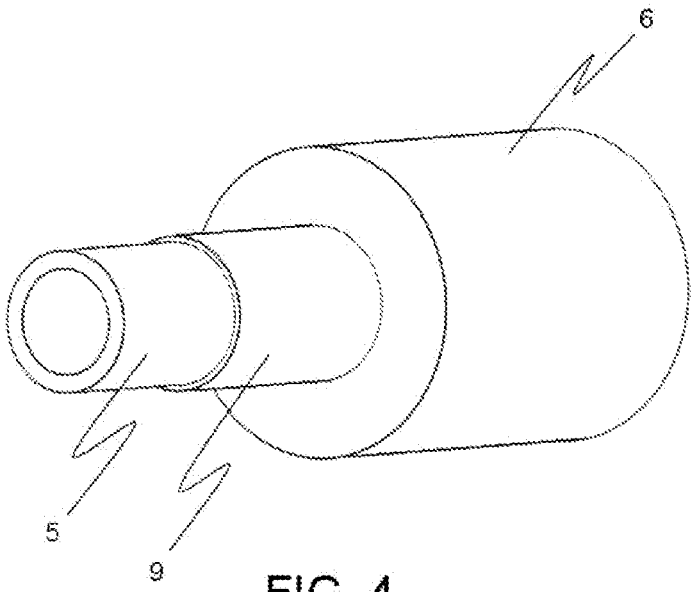
FIG. 4 shows an explosion view perspective cross section of a piece using the formation of the first isobaric structure of the present invention.
Figure 6:
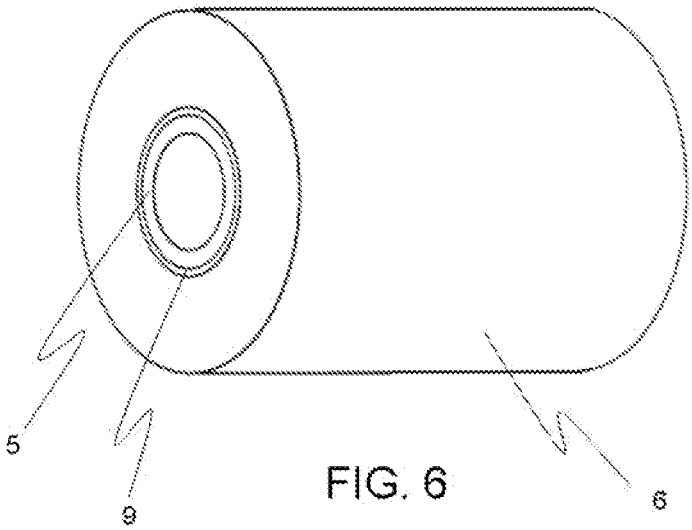
FIG. 6 shows a perspective cross section of a piece of the formation of the second isobaric structure of the present invention.
Figure 7:
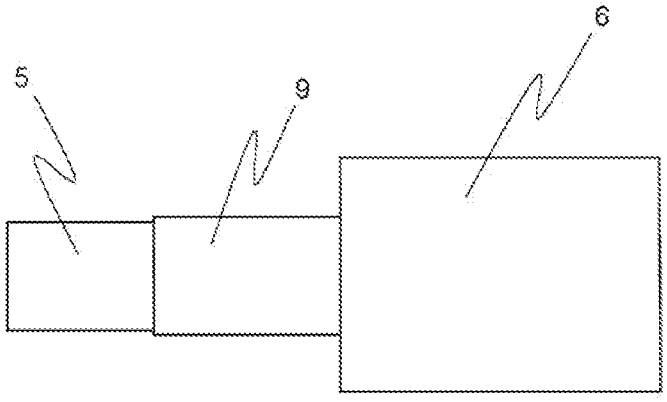
FIG. 7 shows the lateral view of FIG. 4.
Figure 8:
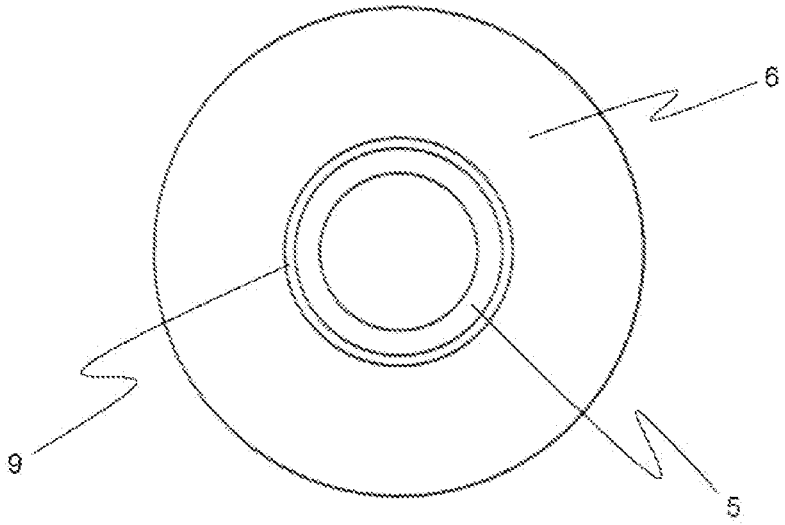
FIG. 8 shows a front view of FIG. 4.

FIGS. 4 and 7 show a thermoplastic PVC tube (5) acting as the core and having its external surface—duly treated—to provide good bonding/anchorage—for one or more successive layers of wrapped fiber glass mat (9) saturated with thermosetting resin, where said layer of fiber glass is firmly bonded to the external surface of said PVC tubes (5) thus forming a single block composite material that acts monolithically. Then, over the adherence bridge material formed by glass fiber mat (9) saturated thermosetting resin, before curing, another thermosetting polymer composite material is applied whose constituent resin is compatible or identical to that in the adherence bridge and both cure together, to form profile (6), which also becomes monolithically integrated to the adherence bridge generated by glass fiber thus conforming a triad of polymer composite material that acts as a single monoblock resisting structure, as shown in FIGS. 6 and 8.

Figure 9:
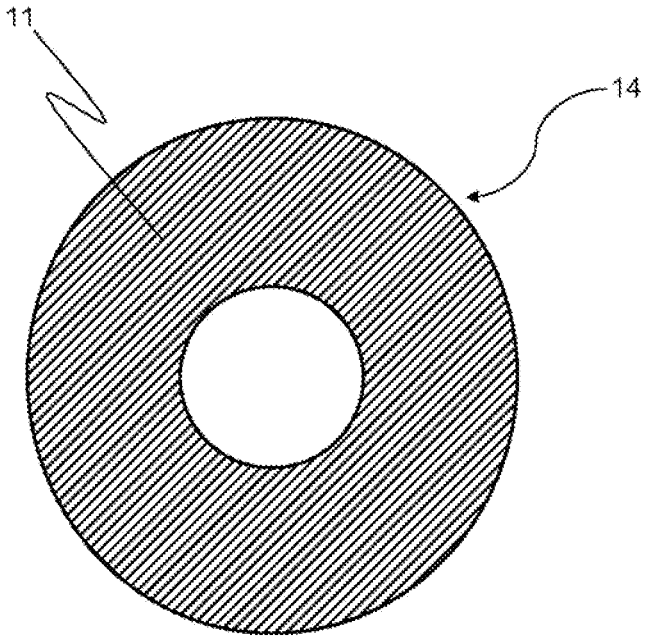
FIG. 9 shows a cross section of the monolithic of quadruplet materials.

FIG. 9 shows a cross section view of the internal face (11) of the monoblock structure (14) formed by the triad polymer composites material described. This monoblock structure (14) allow the 3 constituent materials to behave as a single material (11), allowing to constructed isobaric ring capable of successfully resisting, through prolonged industrial production cycles without loosing its structural nor pneumatic integrity all the mechanical stress to which it may be subjected once installed and operating near the bottom of an electrolyte cell, plus all stresses during its manipulation for installation and removal from the cell, including for example, even accidental falls of the complete structural frame itself from the crane while hauling it up over the cell.

Figure 10:
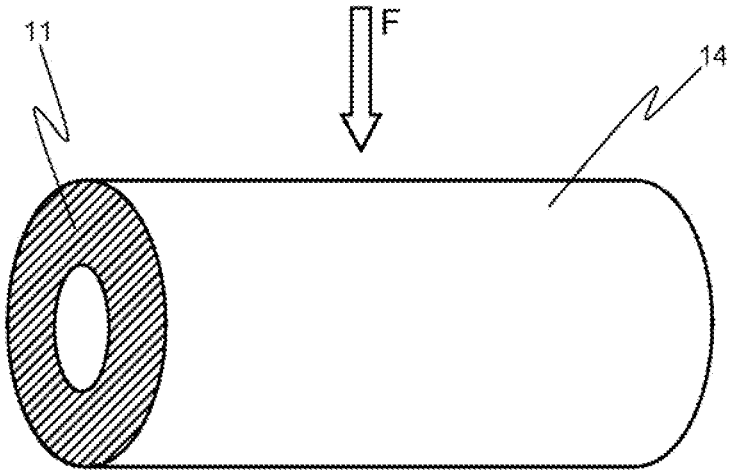
FIG. 10 shows in perspective a cross section of the isobaric structure of the present invention, both of the triad composite material as well quadruplet composite material, with the monolithic structure effect when subjected to extreme external stresses, such as impacts.

In FIG. 10 it is possible to observe that in case of a stress generated by of force (F) the monoblock structure (14) remains perfectly rigid, does not suffer any deformation and is capable of resisting, severe stresses such as those generated in an eventual fall of cathodes or cathode metal plates at the time of harvest, which are also represented by such force (F).

To illustrate the increased structural resistance and rigidity (toughness gained by higher modules of elasticity) between the cross section of isobaric ring formed by the duet hollow PVC profile/encapsulating thermosetting polymer material structural profile with respect to the triad hollow PVC profile/encapsulating thermosetting polymer composite material structural profile/tension wound glass fiber saturated with thermosetting resin, the ultimate strength at rupture of a sample of the same dimensions in the same flexotraction test, of the monoblock triad is at least 2, 5 times more resistant than the sample formed by the monoblock duet composite material.

Figure 13:
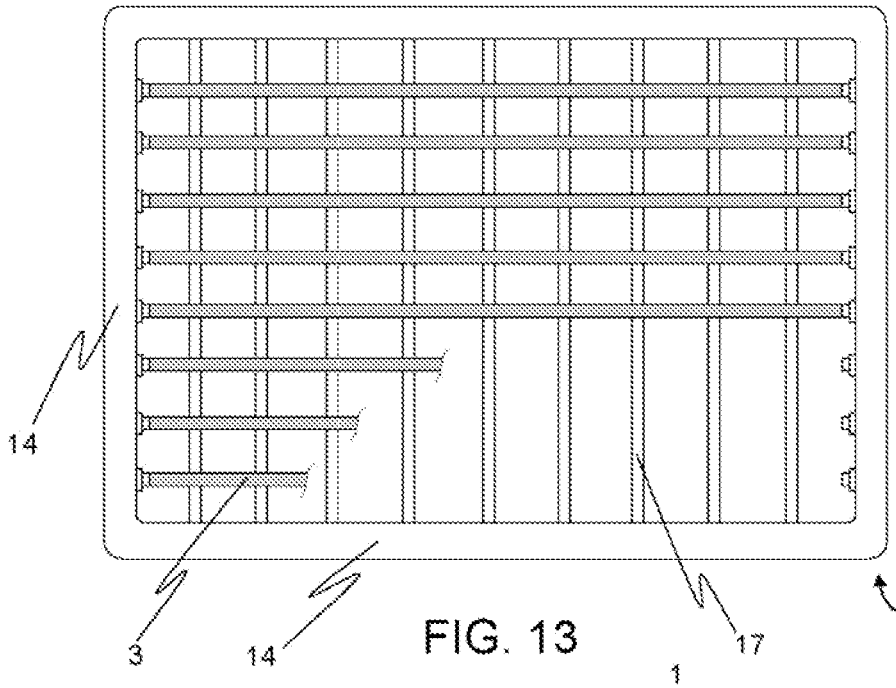
FIG. 13 shows a top view of the molded isobaric structure, formed and assembled with a triad or quadruplet monolithic polymer composite material, according to the present invention

The isobaric structure formed with the monoblock composite profile can be molded, first assembling a ring formed by PVC tubes (5), attaching elbow coupling (15) in the corners, and "T" couplings (16) that allow connecting perforated horses (3) to the ring, having the external PVC tube surfaces one or more successive layers of wrapped mat fiber (9) saturated with a thermosetting resin, where said layers of glass fiber are firmly bonded to the external surface of said PVC tubes (5). After this, said assembled pneumatically hermetic ring is placed in a mold so that the encapsulating thermosetting polymer composite material or structural composite (6) can be poured to form the monolithic structural resisting profile upon curing. In this case, the result will be a monoblock continuous profile around the perimeter of the ring, of the present invention as is shown in FIG. 13.

Figure 11:
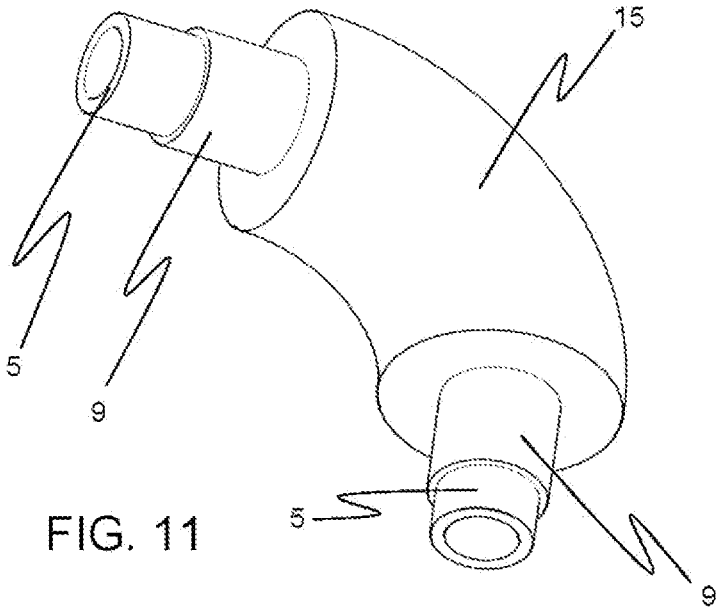
FIG. 11 shows a perspective of a 90° elbow coupling used in the corners to form an isobaric structure according to the present invention.
Figure 12:
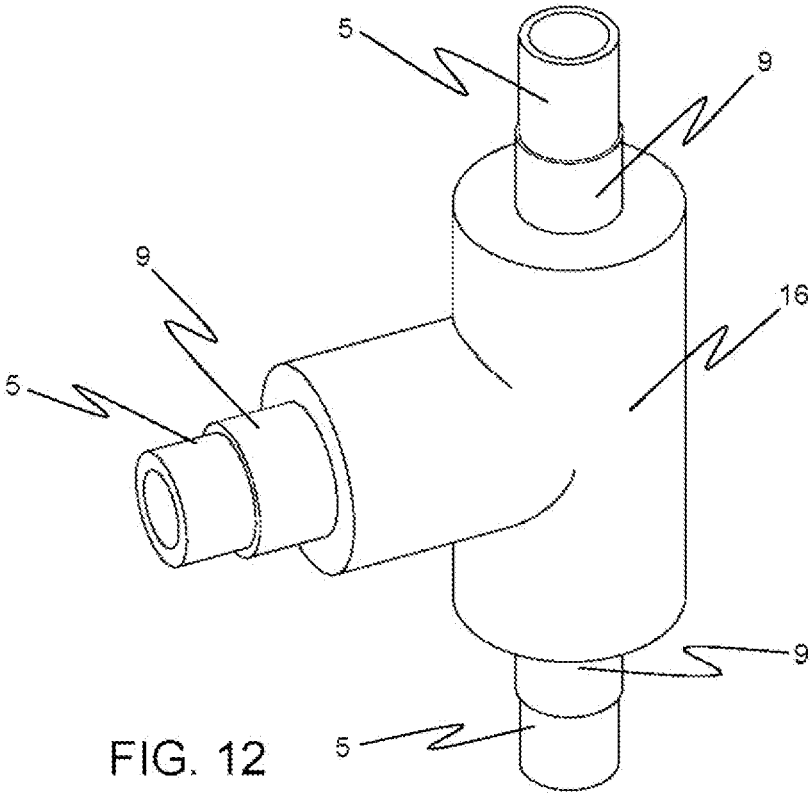
FIG. 12 shows a perspective of the "T" coupling used to form isobaric structure according to present invention.
Figure 14:
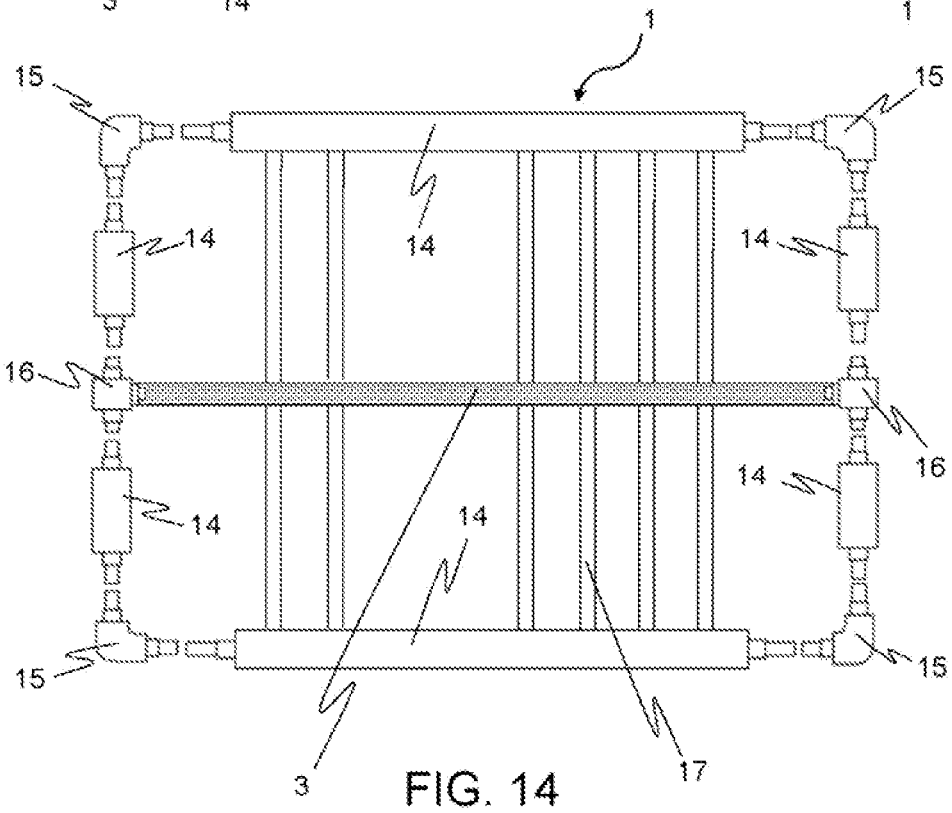
FIG. 14 shows a top view of the laminated isobaric structure formed by the triad or quadruplet monolithic polymer composite material, according to the present invention.

Said isobaric structure can also be sequentially laminated by parts. To do this only the PVC tubes (5) with the glass fiber (9) and the encapsulating polymer composite material (6) are assembled and bonded for subsequent lamination, thus forming a monoblock structure of the present invention, as is shown in FIG. 10. Likewise, a PVC elbow is laminated with glass fiber and encapsulated in thermosetting polymer composite material, thus forming, an independent component such monoblock (15) elbow shown in FIG. 11. Likewise, a "T" component PVC coupling is laminated with glass fiber and encapsulated with thermosetting polymer composite material, thus forming an independent component, as monoblock "T" coupling (16) shown in FIG. 12. The monoblock tubes (14), the monoblock elbow coupling (15) and the "T" monoblock coupling (16) are assembled and bonded together to form the finished isobaric structure. The assembly of elbows (15) and "T" coupling (16) with the monoblock tubes (14) are sealed pouring thermosetting polymer composite material in the joints of these components to bond them together and form one single resisting structure. Under these conditions, an effective isobaric structure will be obtained, in which its constituent components can be discerned, as shown in FIG. 14.

Figure 5:
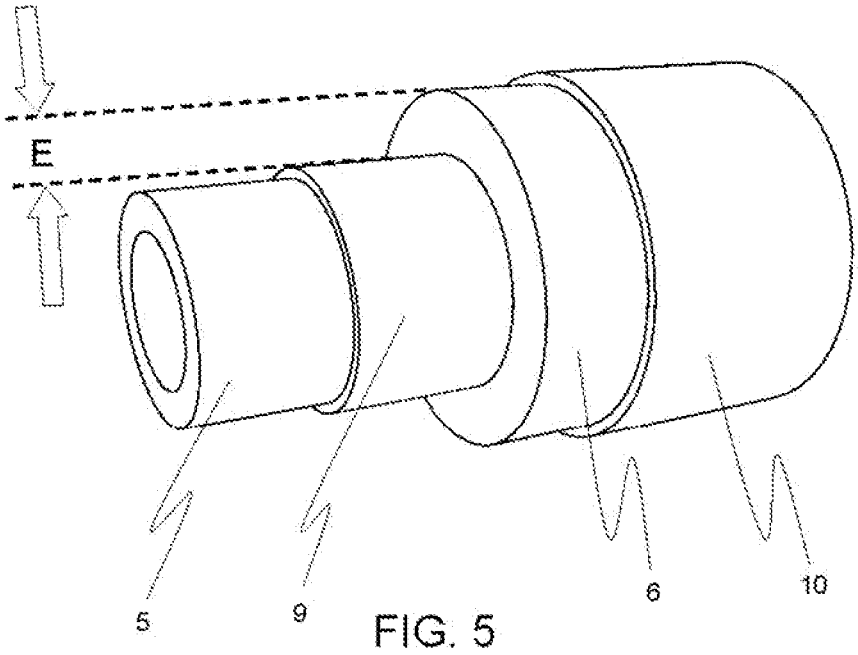
FIG. 5 shows an explosion view perspective cross section of a piece in of the formation of the second isobaric structure of the present invention.

In both cases, manufacturing by molding or laminated by winding both with external thermosetting polymer composite, the isobaric structure formed by a monoblock of a triad material can also be formed of a quadruplet material. This execution is shown in FIG. 5, where over the polymer composite material surface or structural composite (6), one or more successive layers of glass fiber mat (10) are wrapped saturated with thermosetting resin, to impart higher resistance to the monoblock structure. As shown in FIG. 5, the effect of adding a fourth layer of glass fiber (10) results in reduction of thickness "E" in the profile formed by the polymer material or structure composite (6).

Both with the triad or quadruplet sets of material, the monoblock acts as a single body unit, allowing the structure to resist as one collaborating body all the mechanical and structural stresses, including the more extreme cases, such as impacts from falling cathodes, etc., maintaining intact the structural integrity, and more importantly, also absolute pneumatic hermeticity.

The isobaric ring formed by the triad of quadruplet set of material is provided with transversal structural elements (17) that can be hollow to join the long sides, in such a way as to provide support of the diffusers or perforated hoses (3) which are connected between the shorter sides, where these perforated hoses (3) generate the gas bubbles that enhance the electrowinning process. These transversal structural elements, hollow or solid (17), are used in the molded isobaric ring shown in FIG. 13, or else, in the isobaric ring a shown in FIG. 14, generating one singular monolithic structure of the reticulated frame type for the support of perforated hoses (3).

Figure 15:
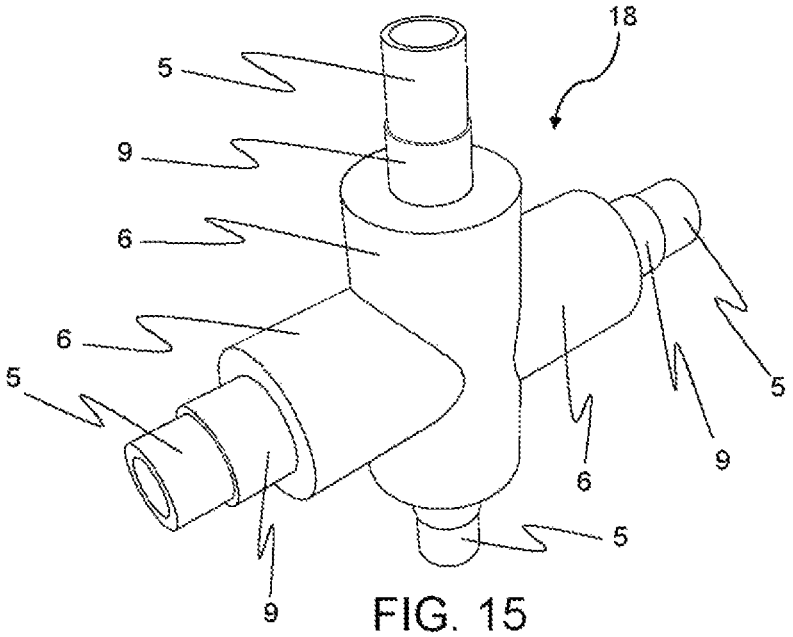
FIG. 15 shows an explosion perspective of the cross type coupling used to form an isobaric structure according to the present invention.
Figure 16:
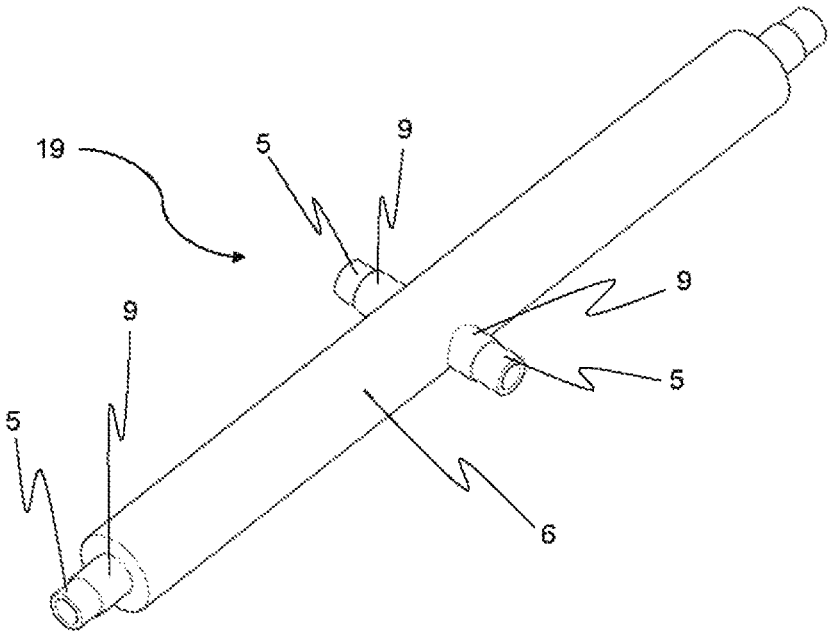
FIG. 16 shows an explosion perspective of a round or circular profile used to form the internal reticula of the isobaric structure, according to the present invention.
Figure 17:
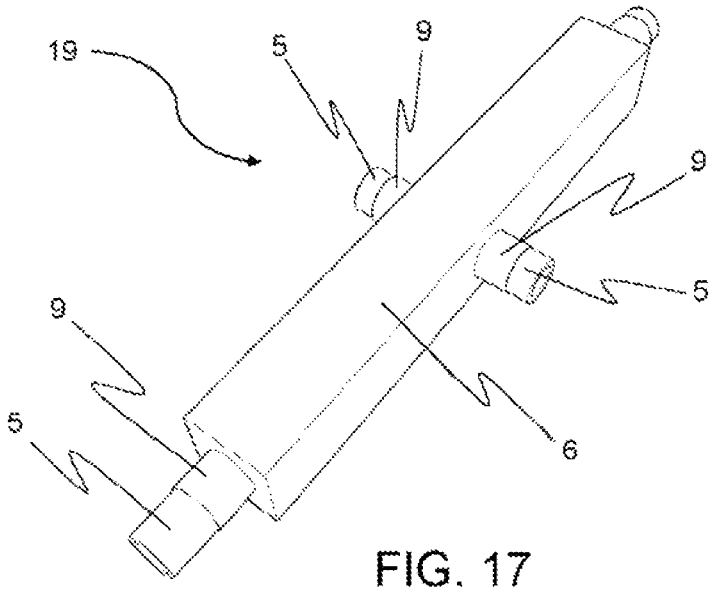
FIG. 17 shows a perspective in explosion view of a rectangular profile used to form the reticula construction, according to the present invention.

The structural elements can be shorter, allowing them to be joined by sections, as shown in FIG. 16, having round profile, or else, in FIG. 17, rectangular profile. In this case, the hollow structural elements are formed by short spans (19) which carry gas or dry air to feed the diffuser or perforated hoses (3). The short spans (19) can be formed by any of the alternatives above mentioned, that is, by a triad or a quadruplet set of materials. FIGS. 16 and 17 show the triad alternative or set of 3 materials. These short spans (19) forming the reticula require a cross type coupling (18) as shown in FIG. 15. Similarly as the other constituent elements of the isobaric structure, this cross type coupling (18) can be formed by the triad or quadruplet set of materials.

Figure 18:
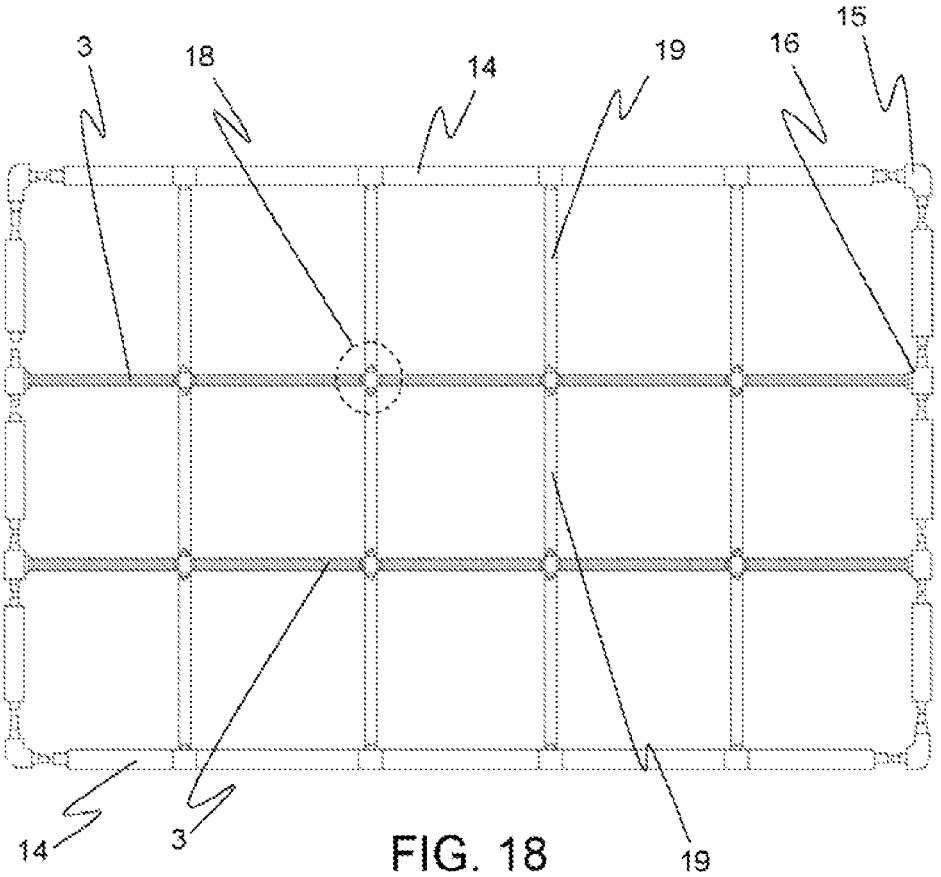
FIG. 18 shows a top view of the laminated isobaric structure formed by the triad or quadruplet monolithic polymer composite material, according to the present invention, where the reticula, in addition to act as support, is also a hollow carrier of air, where this reticula is transverse to the rectangular frame.

This allows the perforated hoses (3), which are flexible, to be shorter, and therefore can be maintained disposed perfectly horizontally while in operation. This configuration is shown in FIG. 18. The short spans (19) can be disposed longitudinally in the rectangular frame as shown in FIG. 18.

These selection of a monoblock structure to be made of 3 or 4 materials will depend on the application requirements and stresses to which the isobaric structure will be subjected to, and of course, on the cost/benet evaluation involved in the operation of the cell.

The invention claimed is:

1. A self supporting isobaric structure for electrolyte aeration in a cell for electrolytic refining or winning non ferrous metals, formed by pipes that follow the perimeter near the bottom of said cell, forming a structure shaped as a rectangular frame that carries gas or dry air, internally having transversal structural elements that structurally connect the longer sides of the frame, where the shorter sides of said frame have connecting tubular elements that join from side to side as gas diffusers which are supported by said transversal elements, characterized in that the materials forming the rectangular frame are:

a first layer made of thermoplastic tubular structural profile (5) as a core;

a second layer made of one or more successive layers of glass fiber mats (9) saturated with thermosetting resin, wherein said one or more layers of glass fiber are firmly bonded to the external surface of said first layer; and a third layer made of a thermosetting polymer composite (6) material applied over said second layer, wherein said first layer (5), said second layer (9) and said third layer (6) bond together as a three layer monoblock structure allowing to construct the rectangular self-supporting isobaric structure for electrolytic aeration in a cell.

2. A self supporting isobaric structure according to claim 1, wherein said three layer monoblock structure is used to fabricate a plurality of elbow couplings, a plurality of "T" couplings and a plurality of cross couplings.

3. A self supporting isobaric structure according to claim 1 characterized in that said core of said frame is a hollow thermoplastic tube.

4. A self supporting isobaric structure according to claim 1 characterized in that said core of said frame is solid.

5. A self supporting isobaric structure according to claim 2 further characterized in that said transversal elements are made of short spans of said monoblock structure, wherein each pair of said transversal elements is joined with each other using opposite ends of one said plurality of said cross type couplings.

6. A self supporting isobaric according claim 5, further characterized in that the short spans are oriented transversely and the perforated hoses are oriented longitudinally with respect to said rectangular frame.

7. A self supporting isobaric structure according to claim 5, further characterized in that the short spans are oriented longitudinally with respect the rectangular frame and the perforated hoses (3) are oriented transversely to said rectangular frame.

8. A self supporting isobaric tube according to claim 5 further characterized in that short spans have a circular cross section.

9. A self supporting isobaric structure according to claim 5 further characterized in that short spans have a rectangular cross section.

* * * * *